US012667214B2

(12) United States Patent
Hughes et al.

(10) Patent No.: US 12,667,214 B2
(45) Date of Patent: Jun. 30, 2026

(54) EASY-ASSEMBLE CROSS

(71) Applicants: Eliott Hughes, South Windsor, CT (US); Keilani Hughes, South Windsor, CT (US)

(72) Inventors: Eliott Hughes, South Windsor, CT (US); Keilani Hughes, South Windsor, CT (US)

( * ) Notice: Subject to any disclaimer, the term of this patent is extended or adjusted under 35 U.S.C. 154(b) by 189 days.

(21) Appl. No.: 18/333,139

(22) Filed: Jun. 12, 2023

(65) Prior Publication Data

US 2023/0404309 A1 Dec. 21, 2023

Related U.S. Application Data

(60) Provisional application No. 63/352,359, filed on Jun. 15, 2022.

(51) Int. Cl.
*A47G 33/02* (2006.01)

(52) U.S. Cl.
CPC ..... *A47G 33/02* (2013.01)

(58) Field of Classification Search
CPC ..... A47G 33/02
See application file for complete search history.

(56) References Cited

PUBLICATIONS

Brueske, "Cross Lego 3", Jan. 17, 2013, accessed Aug. 14, 2025 at pixels.com/featured/cross-lego-3-john-brueske.html?srsltid-AfmBOop2XYRO6IEDXtSqArQP8ChYGGM05xObCzDWpeeb5Lz-bC5zUH68 (Year: 2013).*
Mpyromaxos, "[Moc]Crucifixion of Jesus", Apr. 17, 2020, accessed Aug. 18, 2025 at www.eurobricks.com/forum/forums/topic/177136-moccrucifixion-of-jesus (Year: 2020).*
Cailliau, "Lego:Dimensions", last modified May 13, 2014, accessed Aug. 20, 2025 at www.cailliau.org/Alphabetica/L/Lego/Dimensions/More Dimensions/BBEditPreviewTemp.html (Year: 2014).*

* cited by examiner

*Primary Examiner* — Kim S. Horger
(74) *Attorney, Agent, or Firm* — Rothwell, Figg, Ernst & Manbeck, P.C.

(57) ABSTRACT

A cross including horizontal and vertical members. The horizontal member may include a central portion having an attach block and a first and second side portions extending from the central portion. The vertical member may include a support portion including an attach block cavity and upper and lower portions extending from the support portion in upward and downward directions. The horizontal member may be configured to attach to the vertical member such that, when attached: a rear surface of the attach block cavity of the vertical member faces the attach block of the horizontal member, side surfaces of the attach block cavity of the vertical member face side surfaces of the attach block of the horizontal member, and the vertical member supports the attach block of the horizontal member.

18 Claims, 16 Drawing Sheets

EASY-ASSEMBLE CROSS

CROSS-REFERENCE TO RELATED APPLICATION

The present application claims the benefit of priority to U.S. Provisional Application Ser. No. 63/352,359, filed on Jun. 15, 2022, which is incorporated herein by reference in its entirety.

BACKGROUND

Field of Invention

The present invention relates generally to a cross and, in particular, to a cross that is easy to assemble and disassemble.

Discussion of the Background

A conventional free-standing, large-sized (e.g., greater than 5 feet in height) cross is made out of solid wood beams or other solid materials and presents challenges due to weight and stability. This leads to the cross being relatively difficult to transport, assemble, disassemble, and store. A conventional cross is not intended or designed to be repeatedly assembled and disassembled, which makes a conventional cross impractical as a seasonal furnishing and/or decorative item. As a seasonal item, a solid cross is impractical due to the weight and the number of individuals required for assembly and disassembly. Additionally, a cross has a weight distribution across its structure that makes the cross top heavy and prone to toppling if not properly secured, and this safety concern is magnified by the weight of the solid structure.

SUMMARY

Aspects of the invention may overcome one or more of the problems associated with conventional crosses by providing a cross including a vertical member and a horizontal member capable of being easily attached to the vertical member. In some aspects, the horizontal member may be configured to attach to the vertical member with minimal or no use of tools. In some aspects, the horizontal member and/or the vertical member may have a hollow cross-section to minimize weight of the cross as well as the potential for the cross to topple. In some aspects, the cross may include an internal connection structure (e.g., including an attach block and an attach block cavity) that enables the horizontal member to attach to the vertical member without the connection structure being visible (e.g., at least not visible from the front, the left side, and/or right side). In some aspects, the cross may be configured for repeated assembly and disassembly (e.g., by one or two persons). In some aspects, the cross may be suitable for seasonal and/or decorative usage. In some aspects, the cross may be configured to utilize a weighted base (e.g., via an adapter).

One aspect of the invention may provide a cross including a horizontal member and a vertical member. The horizontal member may include a central portion, a first side portion, and a second side portion. The central portion may include an attach block, and the attach block may include first and second side attach block surfaces and a front attach block surface extending between the first and second side attach block surfaces. In some aspects, the first side portion may extend from the central portion in a first horizontal direction, and the first side portion may include front, rear, top, and bottom surfaces. The second side portion may extend from the central portion in a second horizontal direction opposite to the first horizontal direction, and the second side portion may include front, rear, top, and bottom surfaces. The vertical member may include a support portion, an upper portion, and a lower portion. The support portion may include an attach block cavity, and the attach block cavity may include first and second cavity side surfaces and a cavity rear surface. The upper portion may extend from the support portion in an upward direction, and the upper portion may include a front surface, a rear surface, a first side surface, and a second side surface. The lower portion may extend from the support portion in a downward direction, and the lower portion may include a front surface, a rear surface, a first side surface, and a second side surface. The horizontal member may be configured to attach to the vertical member such that, when attached, the cavity rear surface of the attach block cavity of the vertical member faces the front attach block surface of the attach block of the horizontal member. The horizontal member may be configured to attach to the vertical member such that, when attached, the first cavity side surface of the attach block cavity of the vertical member faces the first side attach block surface of the attach block of the horizontal member. The horizontal member may be configured to attach to the vertical member such that, when attached, the second cavity side surface of the attach block cavity of the vertical member faces the second side attach block surface of the attach block of the horizontal member. The horizontal member may be configured to attach to the vertical member such that, when attached, the vertical member supports the attach block of the horizontal member.

In some aspects, the support portion of the vertical member may support the attach block of the horizontal member. In some aspects, the upper and lower portions of the vertical member may be hollow. In some aspects, the first and second side portions of the horizontal member may be hollow.

In some aspects, the cross may further include a rail system configured to facilitate attachment of the horizontal member to the vertical member. In some aspects, the rail system may include a first rail component on the first cavity side surface of the attach block cavity of the vertical member, a second rail component on the second cavity side surface of the attach block cavity of the vertical member, a third rail component on the first side attach block surface of the attach block of the horizontal member and configured to interact with the first rail component during attachment of the horizontal member to the vertical member, and a fourth rail component on the second side attach block surface of the attach block of the horizontal member and configured to interact with the second rail component during attachment of the horizontal member to the vertical member.

In some aspects, the vertical member may include a rear vertical panel including front and rear surfaces, the cavity rear surface of the support portion of the vertical member may include a portion of the front surface of the rear vertical panel, the rear surface of the upper portion of the vertical member may include an upper portion of the rear surface of the rear vertical panel of the vertical member, and the rear surface of the lower portion of the vertical member may include a lower portion of the rear surface of the rear vertical panel of the vertical member. In some aspects, the cross may further include one or more attachment components (e.g., one or more screws) configured to attach the attach block of the horizontal member to the rear vertical panel of the vertical member.

In some aspects, the vertical member may include a first side vertical panel including inner and outer side surfaces, the first cavity side surface of the attach block cavity of the vertical member may include a portion of the inner side surface of the first side vertical panel, the first side surface of the upper portion of the vertical member may include an upper portion of the outer side surface of the first side vertical panel, and the first side surface of the lower portion of the vertical member may include a lower portion of the outer side surface of the first side vertical panel.

In some aspects, the vertical member may include a second side vertical panel including inner and outer side surfaces, the second cavity side surface of the attach block cavity of the vertical member may include a portion of the inner side surface of the second side vertical panel, the second side surface of the upper portion of the vertical member may include an upper portion of the outer side surface of the second side vertical panel, and the second side surface of the lower portion of the vertical member may include a lower portion of the outer side surface of the second side vertical panel.

In some aspects, the upper portion of the vertical member may include an upper front vertical panel, the front surface of the upper portion of the vertical member may include a front portion of the upper front vertical panel, the lower portion of the vertical member may include a lower front vertical panel, and the front surface of the lower portion of the vertical member may include a front portion of the lower front vertical panel.

In some aspects, the horizontal member may include a front horizontal panel including front and rear surfaces, the attach block of the central portion of the horizontal member may extend from the rear surface of the front horizontal panel, the front surface of the first side portion of the horizontal member may include a portion of the front surface of the front horizontal panel, and the front surface of the second side portion of the horizontal member may include a different portion of the front surface of the front horizontal panel. In some aspects, the first and second side attach block surfaces of the attach block may extend from the rear surface of front horizontal panel to the front attach block surface of the attach block. In some aspects, the rear surface of the front horizontal panel of the horizontal member may be configured to abut first and second side vertical panels of the vertical member when the horizontal member is attached to the vertical member.

In some aspects, the first side portion of the horizontal member may include a first side top panel, a first side rear panel, and a first side bottom panel. In some aspects, the top surface of the first side portion of the horizontal member may include a top surface of the first side top panel. In some aspects, the rear surface of the first side portion of the horizontal member may include a rear surface of the first side rear panel. In some aspects, the bottom surface of the first side portion of the horizontal member may include a bottom surface of the first side bottom panel.

In some aspects, the second side portion of the horizontal member may include a second side top panel, a second side rear panel, and a second side bottom panel. In some aspects, the top surface of the second side portion of the horizontal member may include a top surface of the second side top panel. In some aspects, the rear surface of the second side portion of the horizontal member may include a rear surface of the second side rear panel. In some aspects, the bottom surface of the second side portion of the horizontal member may include a bottom surface of the second side bottom panel.

In some aspects, the front attach block surface of the attach block of the horizontal member may be configured to abut the cavity rear surface of the attach block cavity of the vertical member when the horizontal member is attached to the vertical member. In some aspects, the front surfaces of the first and second side portions of the horizontal member may be configured to be flush with the front surfaces of the upper and lower portions of the vertical member when the horizontal member is attached to the vertical member. In some aspects, the rear surfaces of the first and second side portions of the horizontal member may be configured to be flush with the rear surfaces of the upper and lower portions of the vertical member when the horizontal member is attached to the vertical member.

In some aspects, the cross may further include a base configured to attach to the lower portion of the vertical member such that, when attached, the base maintains the vertical member in an upright position. In some aspects, the lower portion of the vertical member may include one or more support platforms, each of the one or more support platforms may include an opening through the support platform, and the cross may further include a support rod configured to extend from the base projection and through the opening(s) of the one or more support platforms. In some aspects, the base may include a base projection configured to be inserted into the lower portion of the vertical member. In some aspects, the base may include a base projection configured to receive the lower portion of the vertical member.

Still another aspect of the invention may provide a cross including a horizontal member, a vertical member, a base, and a support rod. The vertical member may include a support portion, an upper portion extending from the support portion in an upward direction, and a lower portion extending from the support portion in a downward direction. The lower portion of the vertical member may include one or more support platforms, and each of the one or more support platforms may include an opening through the support platform. The base may be configured to attach to the lower portion of the vertical member such that, when attached, the base maintains the vertical member in an upright position. The base may include a base projection configured to be inserted into the lower portion of the vertical member. The support rod may be configured to extend from the base projection and through the opening(s) of the one or more support platforms. The horizontal member may be configured to attach to the vertical member such that, when attached, the vertical member supports the horizontal member.

Yet another aspect of the invention may provide a method including inserting a support rod into an opening of a base projection of a base such that the support rod extends from the base projection of the base. The method may include attaching a lower portion of a vertical member to the base such that the base maintains the vertical member in an upright position. Attaching the lower portion of the vertical member to the base may include passing the support rod through an opening in each of one or more support platforms of the lower portion of the vertical member. The method may include attaching a horizontal member to the vertical member.

Still another aspect of the invention may provide any combination of the aspects set forth above.

Further variations encompassed within the systems and methods are described in the detailed description of the invention below.

BRIEF DESCRIPTION OF THE DRAWINGS

The accompanying drawings, which are incorporated herein and form part of the specification, illustrate various, non-limiting embodiments of the present invention. In the drawings, like reference numbers indicate identical or functionally similar elements.

DETAILED DESCRIPTION OF PREFERRED EMBODIMENTS

Figure 1A:
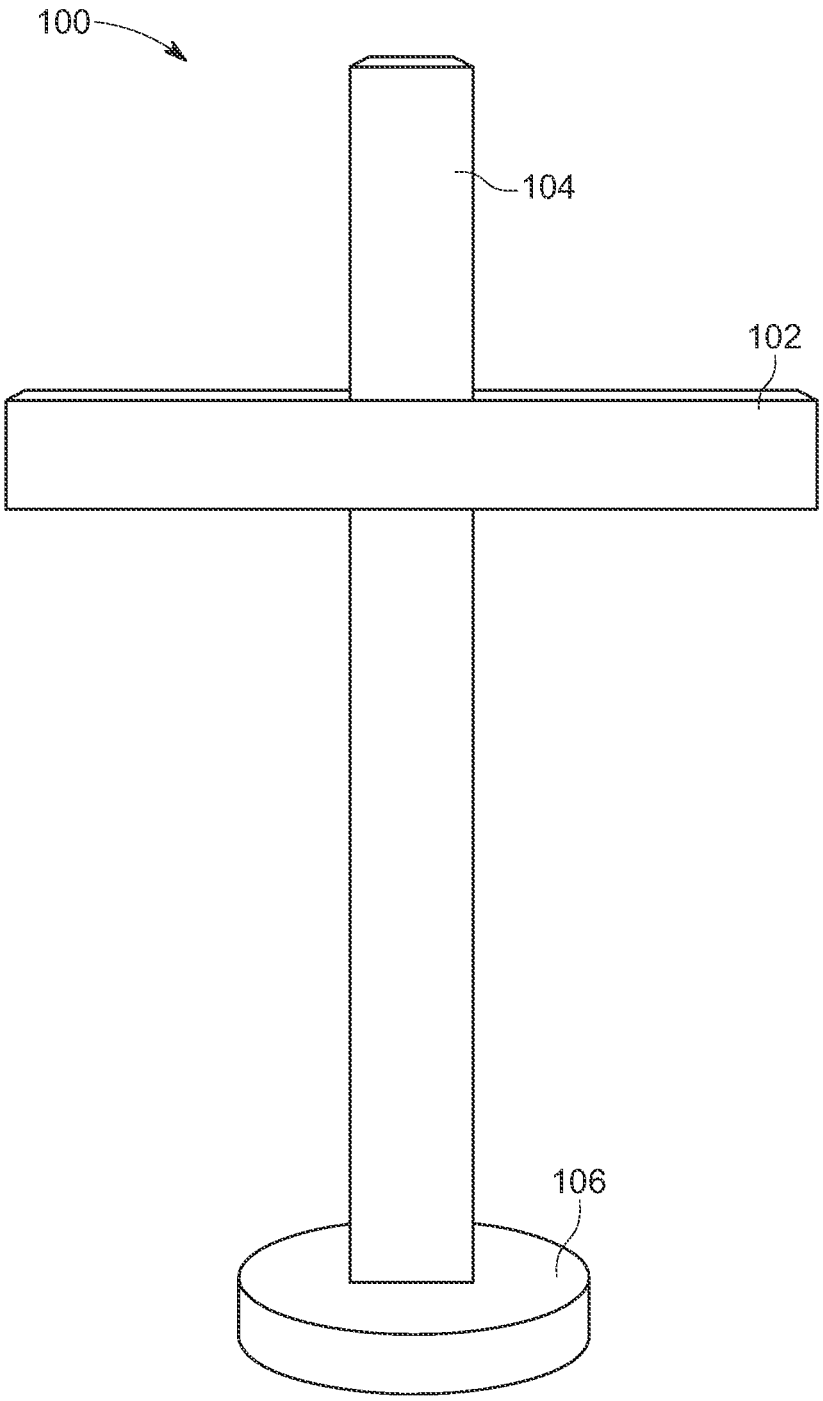
FIG. 1A is a front view of a cross according to some aspects.

FIGS. 1A-1E illustrate a cross 100 according to some aspects. In some aspects, as shown in FIGS. 1A-1E, the cross 100 may be a free-standing cross. In some aspects, the cross 100 may have a large size (e.g., a height of 5 feet or greater). In some aspects, as shown in FIGS. 1A-1E, the cross 100 may include a horizontal member 102, a vertical member 104, and/or a base 106. FIGS. 2A-2G illustrate the horizontal member according to some aspects. FIGS. 3A-3D illustrate the vertical member 104 according to some aspects. FIG. 4 illustrates the base 106 according to some aspects. FIGS. 5A-5D illustrate a support system of the cross 100 according to some aspects.

In some aspects, as shown in FIGS. 2A-2G, the horizontal member 102 may include a central portion 102*a*, a first side portion 102*b*, and a second side portion 102*c*. In some aspects, the central portion 102*a* of the horizontal member 102*a* may include an attach block 202. In some aspects, the attach block 202 may include first and second side attach block surfaces 202*b* and 202*c*. In some aspects, the attach block 202 may include a front attach block surface 202*a* extending between the first and second side attach block surfaces 202*b* and 202*c*. In some aspects, the first side portion 102*b* may extend from the central portion 102*a* in a first horizontal direction (e.g., a leftward direction, which may be perpendicular to the direction of gravity). In some aspects, the first side portion 102*b* may include front, rear, top, and bottom surfaces. In some aspects, the second side portion 102*c* may extend from the central portion 102*a* in a second horizontal direction (e.g., a rightward direction, which may be perpendicular to the direction of gravity) opposite to the first horizontal direction. In some aspects, the second side portion 102*c* may include front, rear, top, and bottom surfaces. In some aspects, as shown in FIGS. 2A-2D, 2F, and 2G, the first side portion 102*b* and/or the second side portion 102*c* of the horizontal member 102 may be hollow.

In some aspects, as shown in FIGS. 2A-2G, the horizontal member 102 may include a front horizontal panel 204 including front and rear surfaces 204*a* and 204*b*. In some aspects, the attach block 202 of the central portion 102*a* of the horizontal member 102 may extend from the rear surface 204*b* of the front horizontal panel 204. In some aspects, the front surface of the first side portion 102*b* of the horizontal member 102 may include a portion of the front surface 204*a* of the front horizontal panel 204, and the front surface of the second side portion 102*c* of the horizontal member 102 may include a different portion of the front surface 204*a* of the front horizontal panel 204. In some aspects, the first and second side attach block surfaces 202*b* and 202*c* of the attach block 202 may extend from the rear surface 204*b* of front horizontal panel 204 to the front attach block surface 202*a* of the attach block 202.

In some aspects, as shown in FIGS. 2A-2G, the first side portion 102*b* of the horizontal member 102 may include a first side top panel 206, a first side rear panel 208, and a first side bottom panel 210. In some aspects, the top surface of the first side portion 102*b* of the horizontal member 102 may include a top surface of the first side top panel 206. In some aspects, the rear surface of the first side portion 102*b* of the horizontal member 102 may include a rear surface of the first side rear panel 208. In some aspects, the bottom surface of the first side portion 102*b* of the horizontal member 102 may include a bottom surface of the first side bottom panel 210.

In some aspects, as shown in FIGS. 2A-2G, the second side portion 102*c* of the horizontal member 102 may include a second side top panel 212, a second side rear panel 214, and a second side bottom panel 216. In some aspects, the top surface of the second side portion 102*c* of the horizontal member 102 may include a top surface of the second side top panel 212. In some aspects, the rear surface of the second side portion 102*c* of the horizontal member 102 may include a rear surface of the second side rear panel 214. In some aspects, the bottom surface of the second side portion 102*c* of the horizontal member 102 may include a bottom surface of the second side bottom panel 216.

In some aspects, as shown in FIGS. 1B-1E, the horizontal member 102 may include end caps 110. For example, as shown in FIGS. 1B-1E, the end caps 110 may be at ends of the first and second side portions 102*b* and 102*c* of the horizontal member 102.

Figure 3A:
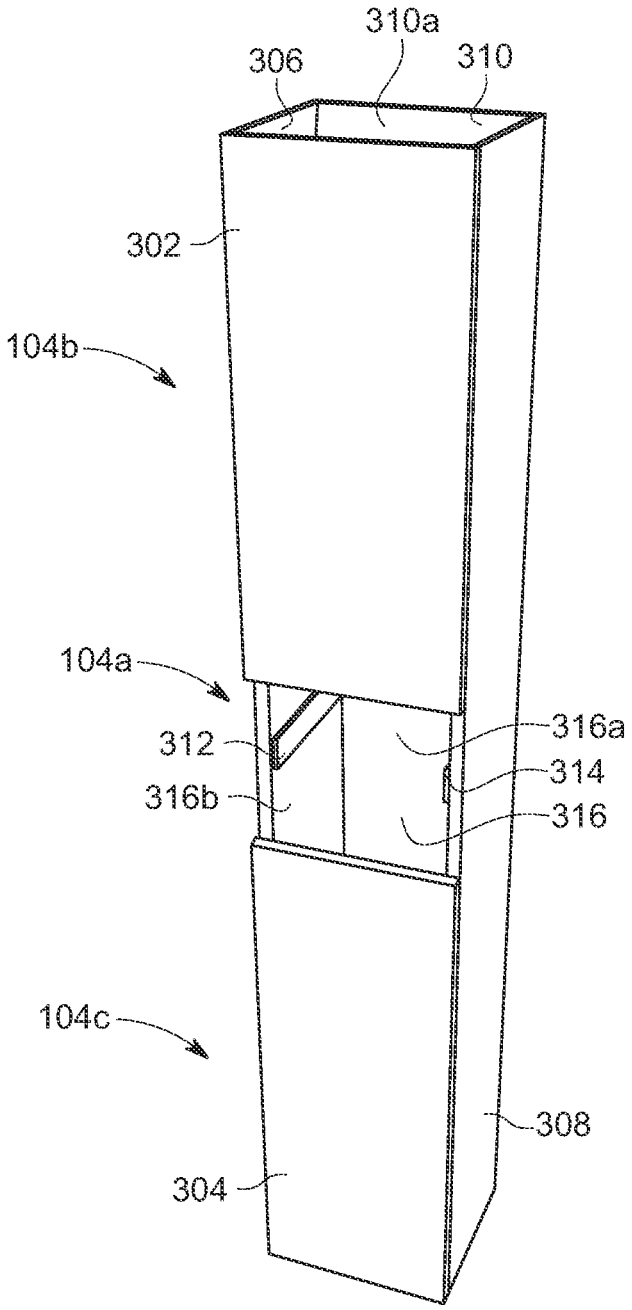
FIG. 3A is a perspective view of a front, right side, and top of a vertical member of a cross according to some aspects.
Figure 3B:
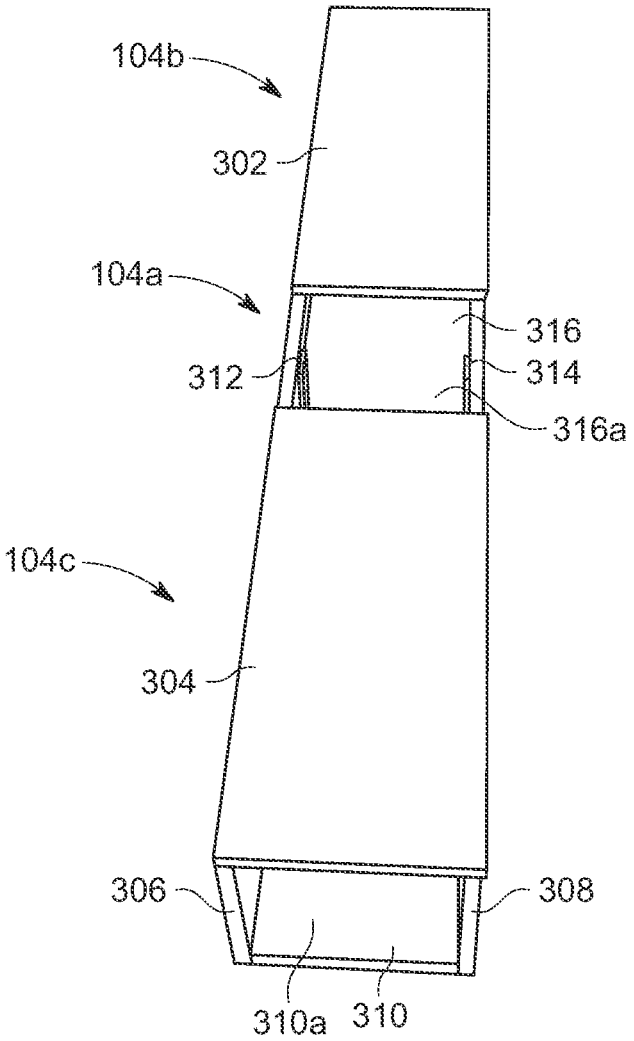
FIG. 3B is a perspective view of a front and bottom of a vertical member of a cross according to some aspects.
Figure 3D:
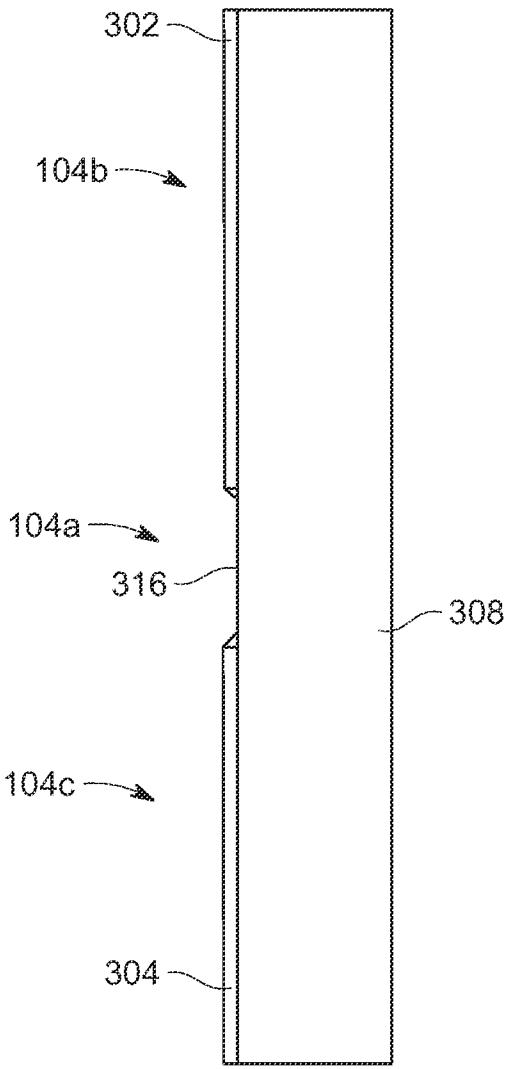
FIG. 3D is a right side view of a vertical member of a cross according to some aspects.

In some aspects, as shown in FIGS. 3A-3D, the vertical member 104 may include a support portion 104*a*, an upper portion 104*b*, and a lower portion 104*c*. In some aspects, the support portion 104*a* may include an attach block cavity 316. In some aspects, the attach block cavity 316 may include first and second cavity side surfaces 316*b* and 316*c* and a cavity rear surface 316*a*. In some aspects, the upper portion 104*b* of the vertical member 104 may extend from the support portion 104*a* in an upward direction. In some aspects, the upper portion 104*b* may include a front surface, a rear surface, a first side surface, and a second side surface. In some aspects, the lower portion 104*c* of the vertical member 104 may extend from the support portion 104*a* in a downward direction (e.g., the direction of gravity). In some aspects, the lower portion 104*c* may include a front surface, a rear surface, a first side surface, and a second side surface. In some aspects, as shown in FIGS. 3A and 3B, the upper portion 104*b* and/or the lower portion 104*c* and of the vertical member 104 may be hollow.

In some aspects, as shown in FIGS. 3A-3D, the upper portion 104*b* of the vertical member 104 may include an upper front vertical panel 302. In some aspects, the front surface of the upper portion 104*b* of the vertical member 104 may include a front portion of the upper front vertical panel 302. In some aspects, the lower portion 104*c* of the vertical member 104 may include a lower front vertical panel 304. In some aspects, the front surface of the lower portion 104*c* of the vertical member 104 may include a front portion of the lower front vertical panel 304.

In some aspects, as shown in FIGS. 3A-3D, the vertical member 104 may include a first side vertical panel 306 including inner and outer side surfaces. In some aspects, the first cavity side surface 316*b* of the attach block cavity 316 of the vertical member 104 may include a portion of the inner side surface of the first side vertical panel 306. In some aspects, the first side surface of the upper portion 104*b* of the vertical member 104 may include an upper portion of the outer side surface of the first side vertical panel 306, and the first side surface of the lower portion 104*c* of the vertical member 104 may include a lower portion of the outer side surface of the first side vertical panel 306.

In some aspects, as shown in FIGS. 3A-3D, the vertical member 104 may include a second side vertical panel 308 including inner and outer side surfaces. In some aspects, the second cavity side surface 316*c* of the attach block cavity 316 of the vertical member 104 may include a portion of the inner side surface of the second side vertical panel 308. In some aspects, the second side surface of the upper portion 104*b* of the vertical member 104 may include an upper portion of the outer side surface of the second side vertical panel 308, and the second side surface of the lower portion 104*c* of the vertical member 104 may include a lower portion of the outer side surface of the second side vertical panel 308.

In some aspects, as shown in FIGS. 3A-3D, the vertical member 104 may include a rear vertical panel 310 including front and rear surfaces 310*a* and 310*b*. In some aspects, the cavity rear surface 316*a* of the support portion 104*a* of the vertical member 104 may include a portion of the front surface 310*a* of the rear vertical panel 310. In some aspects, the rear surface of the upper portion 104*b* of the vertical member 104 may include an upper portion of the rear surface 310*b* of the rear vertical panel 310 of the vertical member 104. In some aspects, the rear surface of the lower portion 104*c* of the vertical member 104 may include a lower portion of the rear surface 310*b* of the rear vertical panel 310 of the vertical member 104.

Figure 1B:
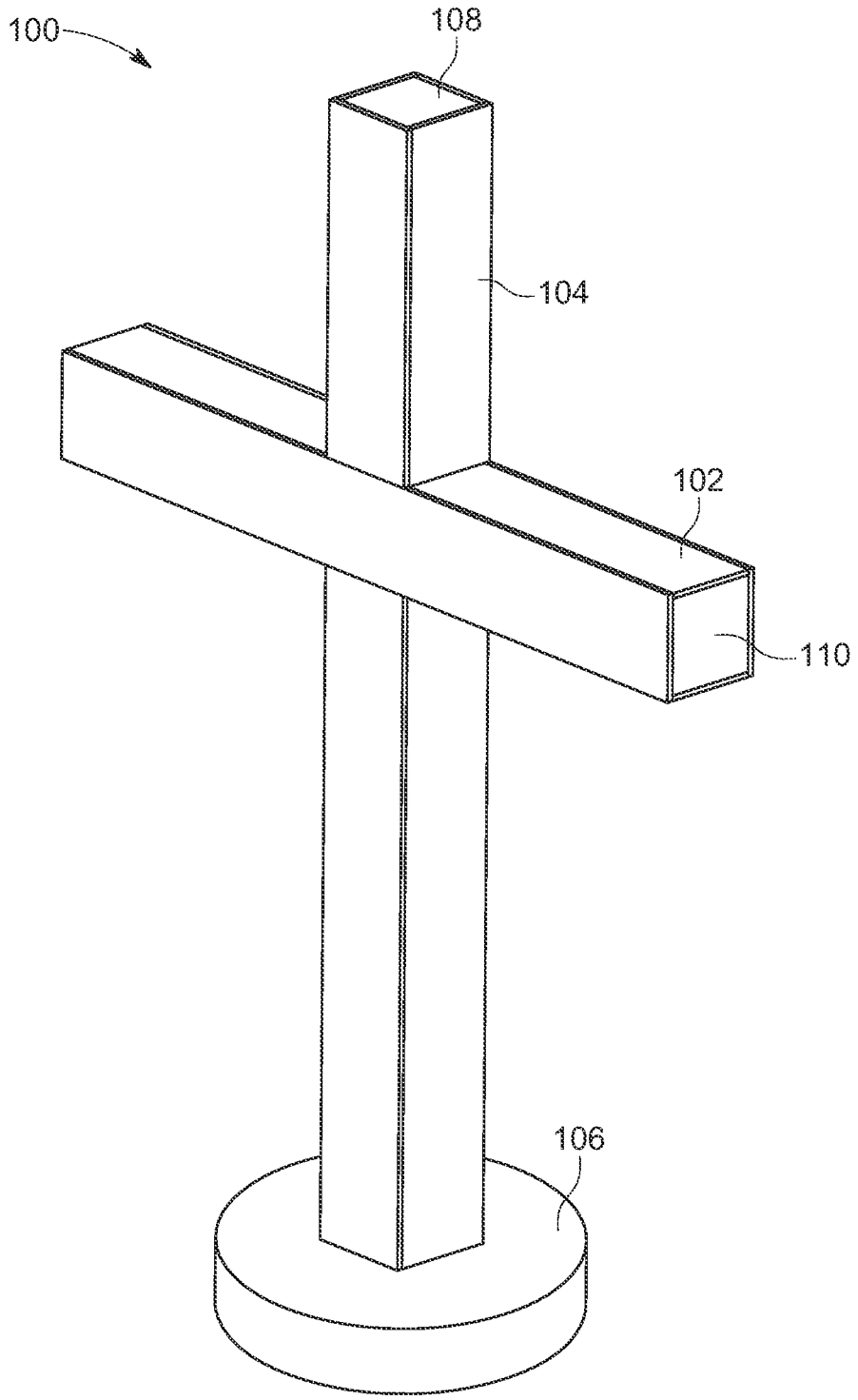
FIG. 1B is a perspective view of a front, right side, and top of a cross according to some aspects.

In some aspects, as shown in FIG. 1B, the vertical member 104 may include a top end cap 108. For example, as shown in FIG. 1B, the top end cap 108 may be at an end of the upper portion 104*b* of the vertical member 104.

In some aspects, as shown in FIGS. 1A-1E, the horizontal member 102 may attach to the vertical member 104. In some aspects, the horizontal member 102 may be configured to attach to the vertical member 104 such that, when attached, the cavity rear surface 316*a* of the attach block cavity 316 of the vertical member 104 faces the front attach block surface 202*a* of the attach block 202 of the horizontal member 102. In some aspects, the horizontal member 102 may be configured to attach to the vertical member 104 such that, when attached, the first cavity side surface 316*b* of the attach block cavity 316 of the vertical member 104 faces the first side attach block surface 202*b* of the attach block 202 of the horizontal member 102. In some aspects, the horizontal member 102 may be configured to attach to the vertical member 104 such that, when attached, the second cavity side surface 316*c* of the attach block cavity 316 of the vertical member 104 faces the second side attach block surface 202*c* of the attach block 202 of the horizontal member 102. In some aspects, the horizontal member 102 may be configured to attach to the vertical member 104 such that, when attached, the vertical member 104 supports the attach block of the horizontal member 102. In some aspects, the support portion 104*a* of the vertical member 104 may support the attach block 202 of the horizontal member 102 when the horizontal member 102 is attached to the vertical member 104.

In some aspects, the rear surface 204*b* of the front horizontal panel 204 of the horizontal member 102 may be configured to abut the first and second side vertical panels 306 and 308 of the vertical member 104 when the horizontal member 102 is attached to the vertical member 104. However, this is not required, and, in some alternative aspects, the rear surface 204*b* of the front horizontal panel 204 may not abut the first and second side vertical panels 306 and 308 when the horizontal member 102 is attached to the vertical member 104. In some aspects, the front attach block surface 202*a* of the attach block 202 of the horizontal member 102 may be configured to abut the cavity rear surface 316*a* of the attach block cavity 316 of the vertical member 104, which may be a portion of the front surface 310*a* of the rear vertical panel 310 of the vertical member 104, when the horizontal member 102 is attached to the vertical member 104. However, this is not required, and, in some alternative aspects, the front attach block surface 202*a* may not abut the cavity rear surface 316*a* when the horizontal member 102 is attached to the vertical member 104.

Figure 1C:
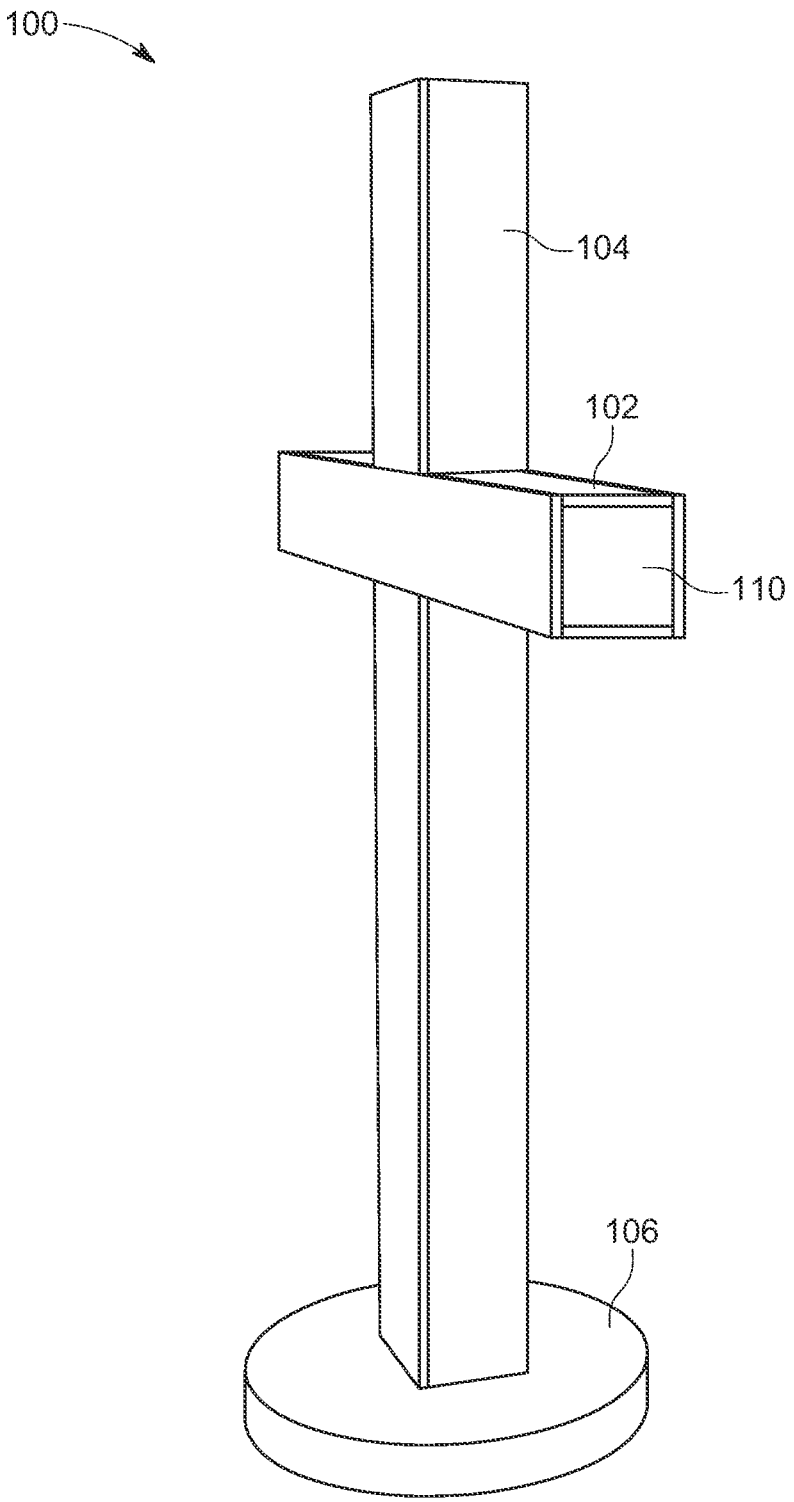
FIG. 1C is a perspective view of a front and right side of a cross according to some aspects.
Figure 1D:
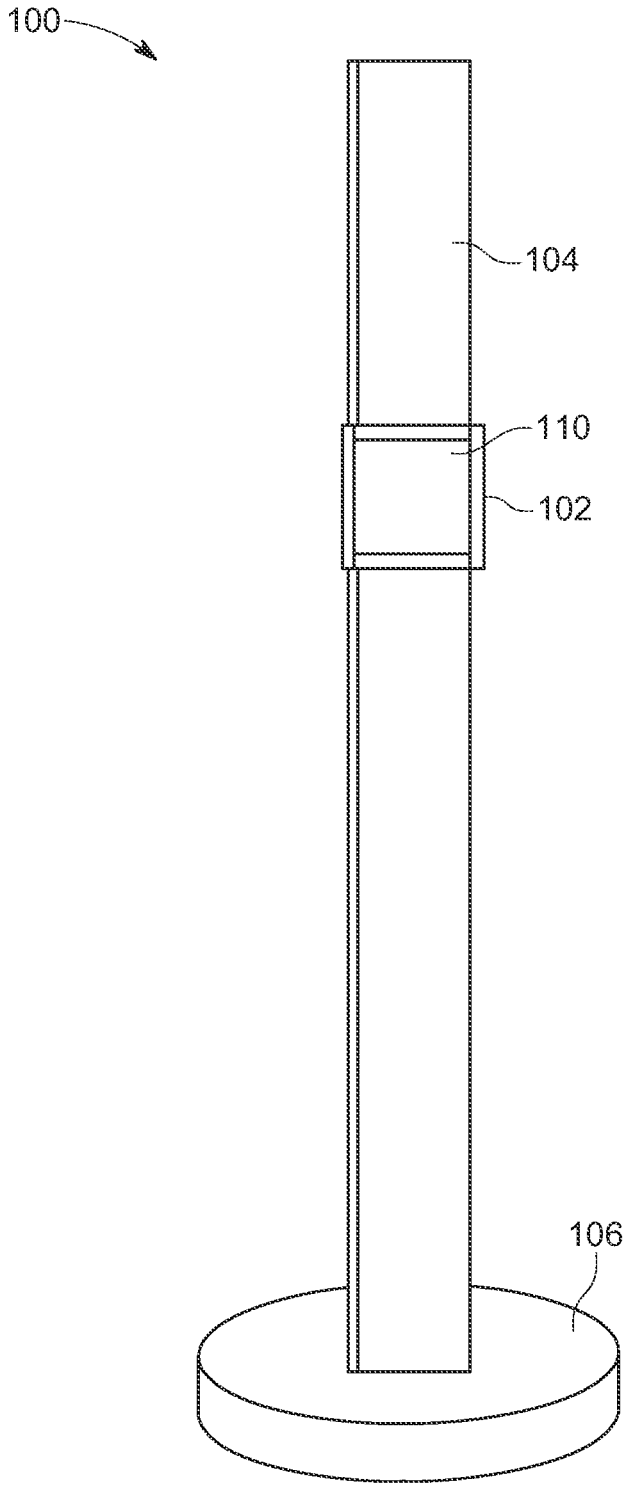
FIG. 1D is a right side view of a cross according to some aspects.

In some aspects, the front surfaces of the first and second side portions 102*b* and 102*c* of the horizontal member 102 (e.g., the front surface 204*a* of the front horizontal panel 204 of the horizontal member 102) may be configured to be flush with the front surfaces of the upper and lower portions 104*b* and 104*c* of the vertical member 104 (e.g., the front surfaces of the upper and lower front vertical panels 302 and 304 of the vertical member 104) when the horizontal member 102 is attached to the vertical member 104. However, this is not required, and, in some alternative aspects, these surfaces may not be flush when the horizontal member 102 is attached to the vertical member 104. For example, in some alternative aspects, as shown in FIGS. 1B-1D, the front surfaces of the first and second side portions 102*b* and 102*c* of the horizontal member 102 may stick out (e.g., stick out slightly) from the front surfaces of the upper and lower portions 104*b* and 104*c* of the vertical member 104 when the horizontal member 102 is attached to the vertical member 104.

In some aspects, the rear surfaces of the first and second side portions 102*b* and 102*c* of the horizontal member 102

Figure 1E:
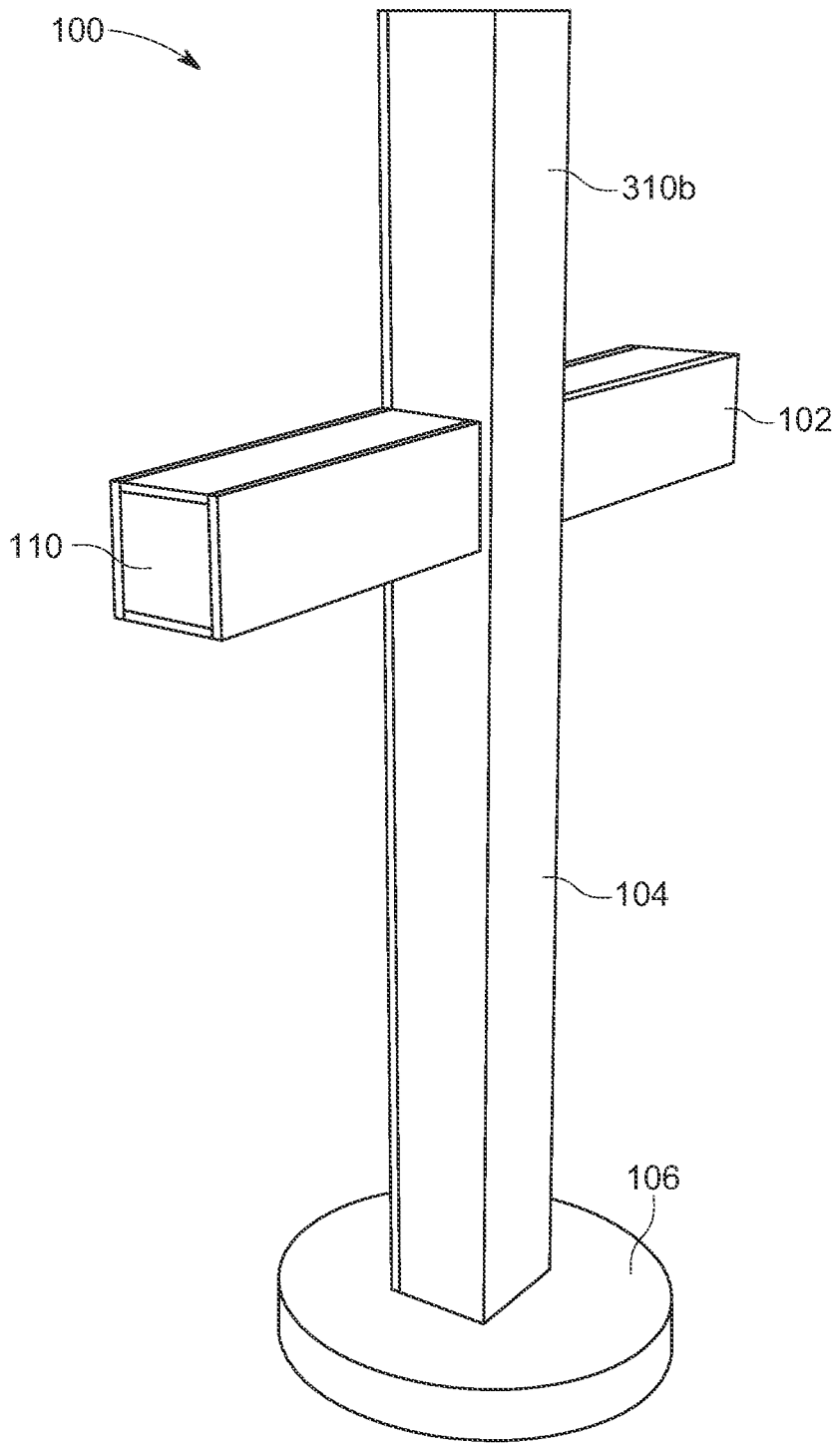
FIG. 1E is a perspective view of a rear and right side of a cross according to some aspects.
Figure 2A:
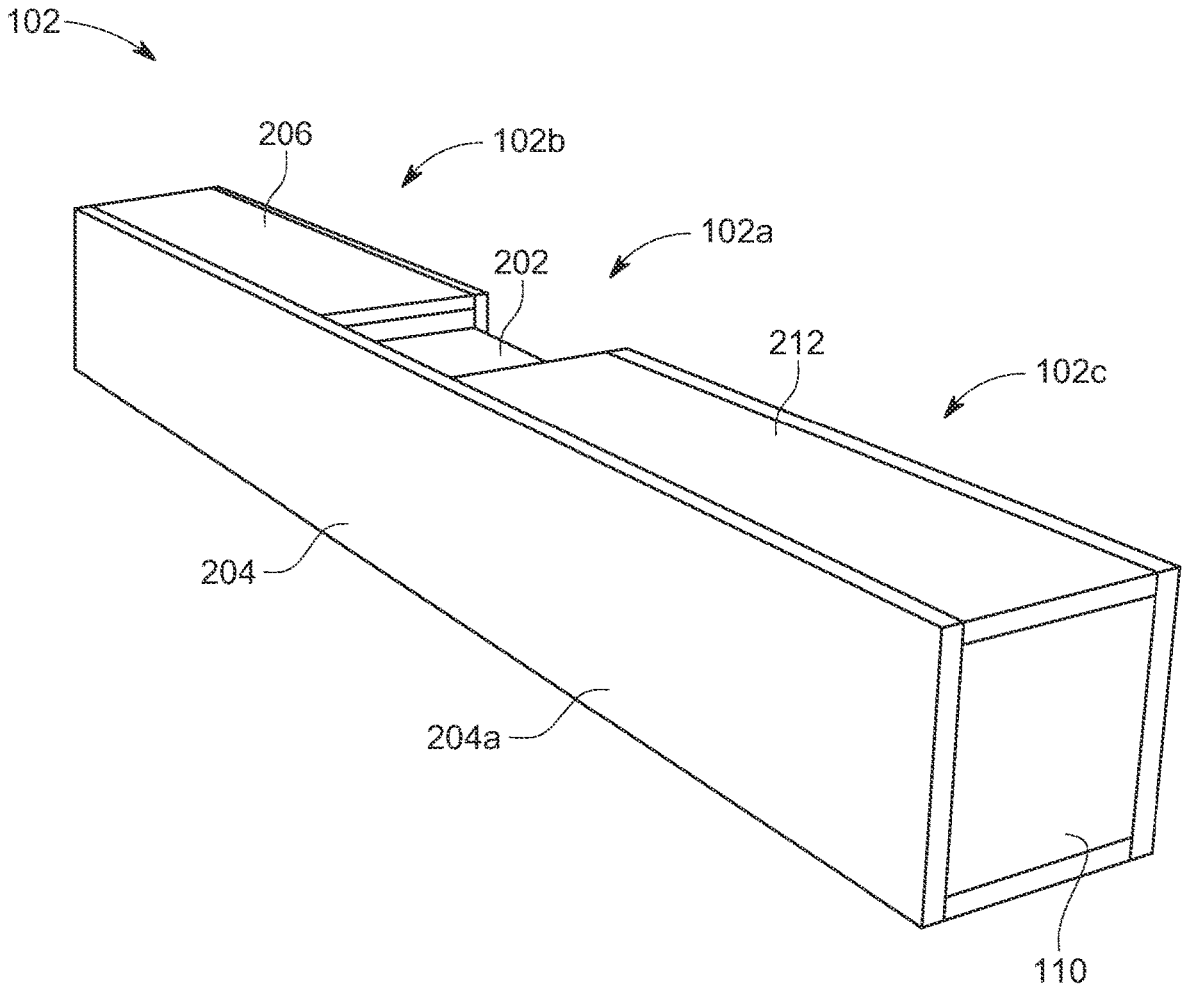
FIG. 2A is a perspective view of a front, right side, and top of a horizontal member of a cross according to some aspects.
Figure 2B:
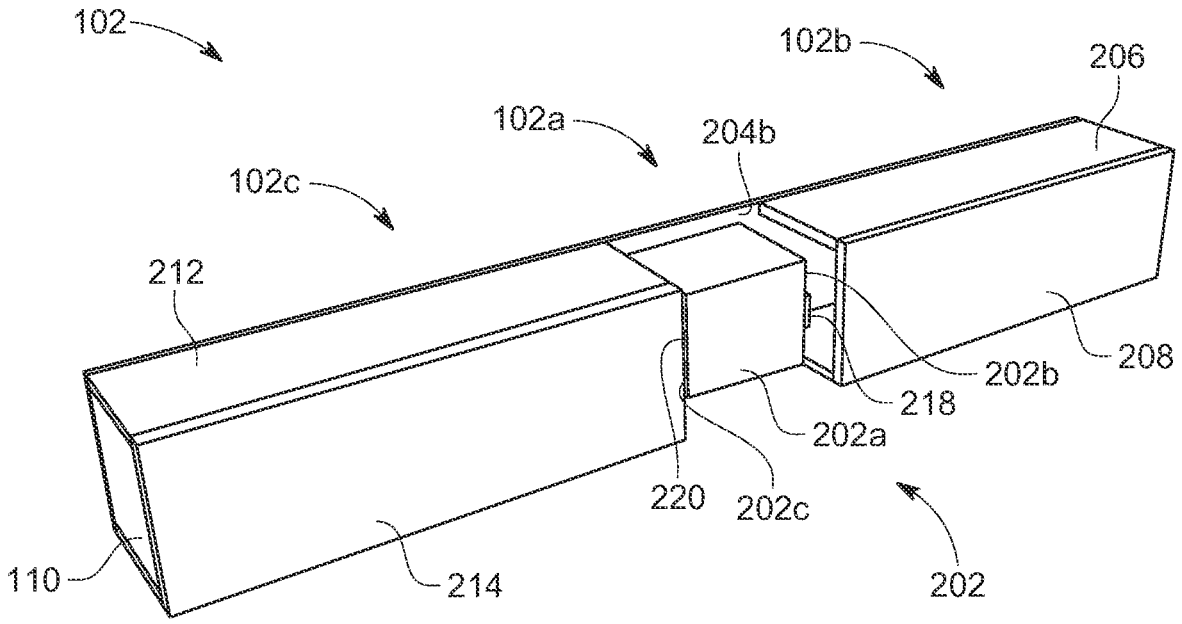
FIG. 2B is a perspective view of a rear, right side, and top of a horizontal member of a cross according to some aspects.
Figure 2C:
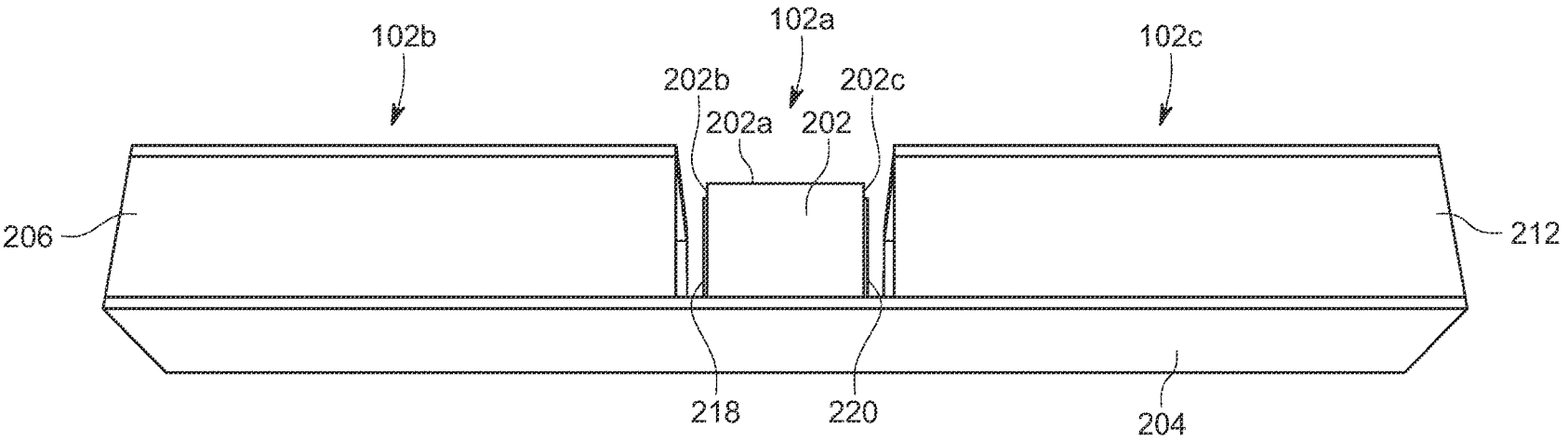
FIG. 2C is a perspective view of a front and top of a horizontal member of a cross according to some aspects.
Figure 2D:
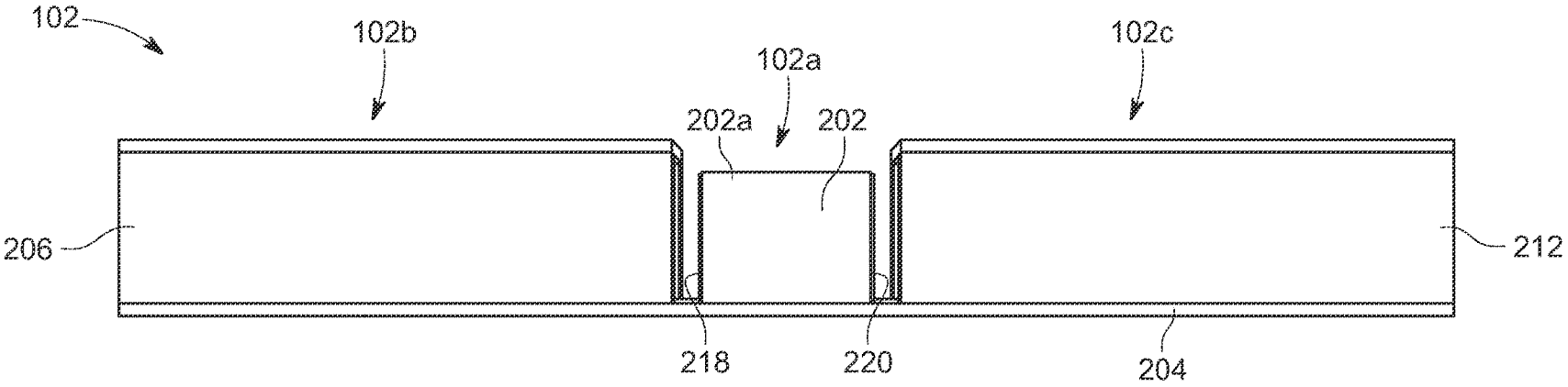
FIG. 2D is a top view of a horizontal member of a cross according to some aspects.
Figure 2E:
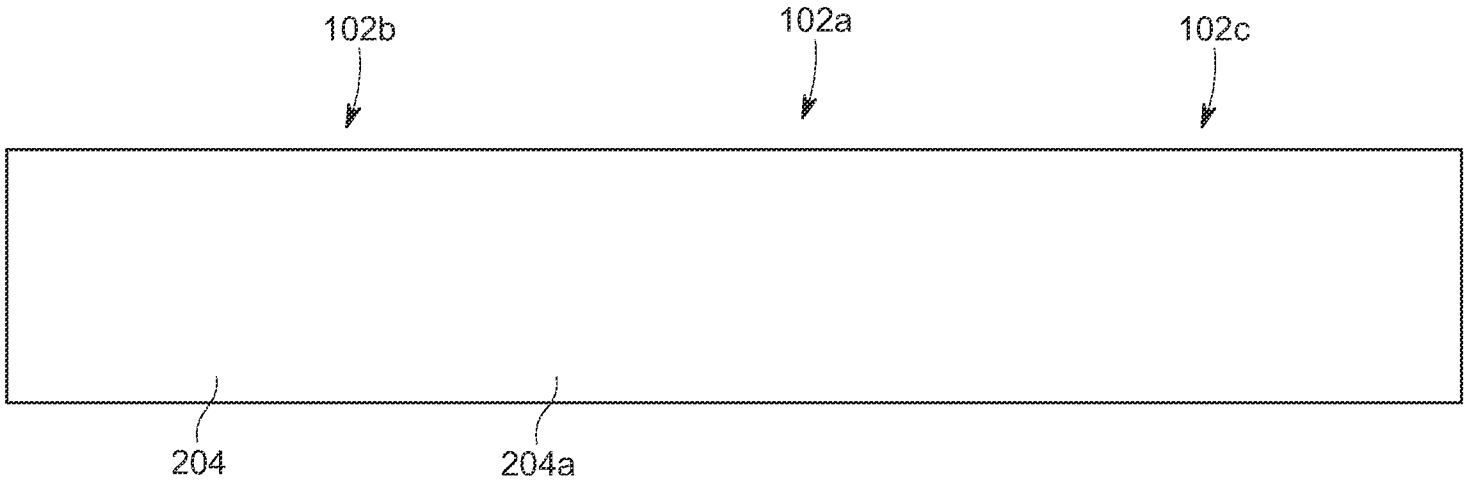
FIG. 2E is a front view of a horizontal member of a cross according to some aspects.
Figure 2F:
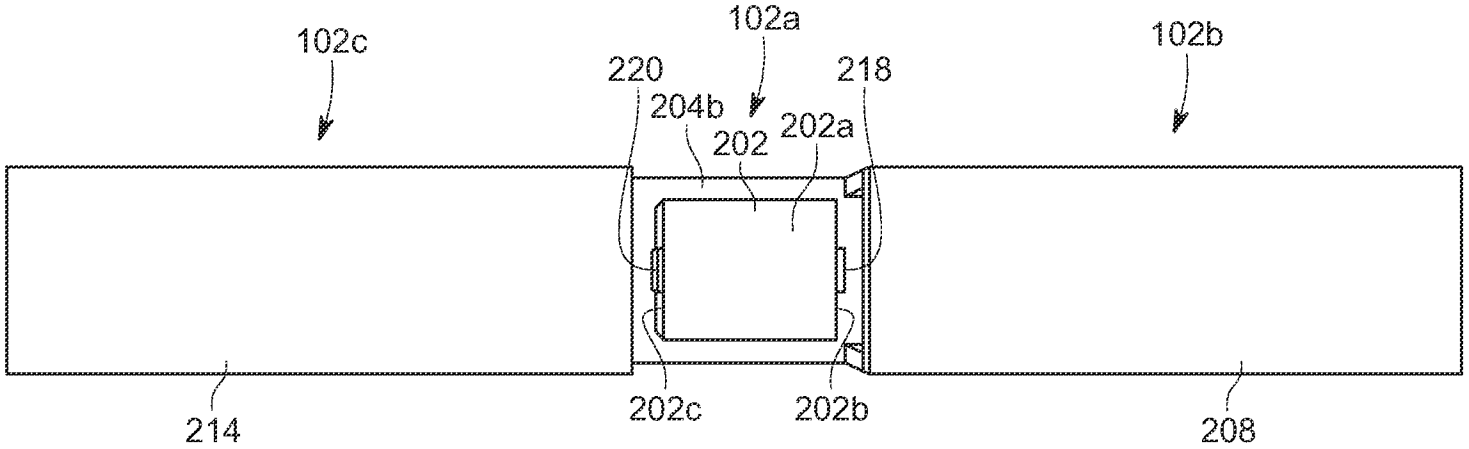
FIG. 2F is a rear view of a horizontal member of a cross according to some aspects.
Figure 2G:
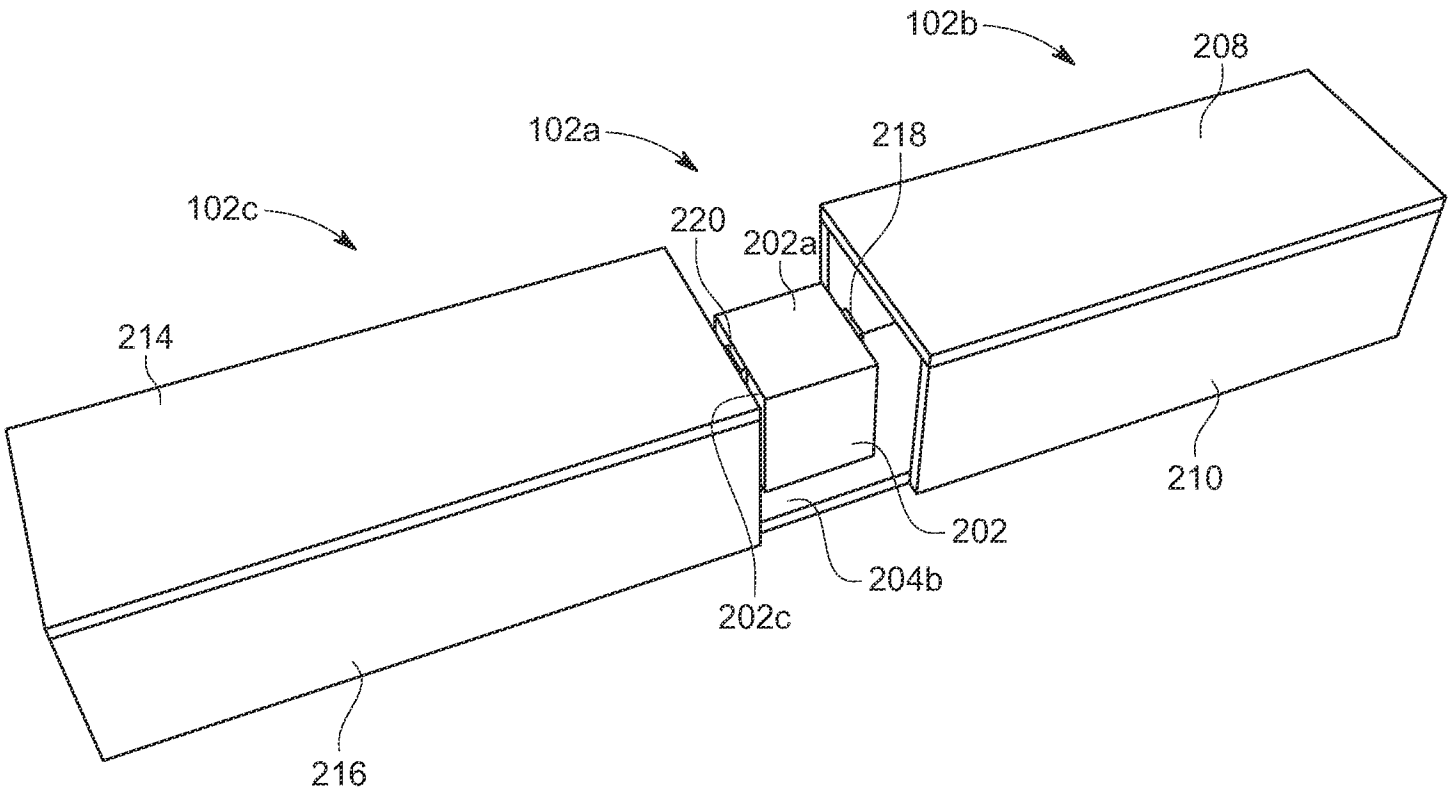
FIG. 2G is a perspective view of a rear and bottom of a horizontal member of a cross according to some aspects.

(e.g., the rear surfaces of the first and second side rear panels 208 and 214 of the horizontal member 102) may be configured to be flush with the rear surfaces of the upper and lower portions 104*b* and 104*c* of the vertical member 104 (e.g., the rear surface 310*b* of the rear vertical panel 310 of the vertical member 104) when the horizontal member 102 is attached to the vertical member 104. However, this is not required, and, in some alternative aspects, these surfaces may not be flush when the horizontal member 102 is attached to the vertical member 104. For example, in some alternative aspects, as shown in FIG. 1E, the rear surfaces of the first and second side portions 102*b* and 102*c* of the horizontal member 102 may not extend all the way to the rear surfaces of the upper and lower portions 104*b* and 104*c* of the vertical member 104 when the horizontal member 102 is attached to the vertical member 104. For another example, in some alternative aspects, as shown in FIG. 1E, the rear surfaces of the first and second side portions 102*b* and 102*c* of the horizontal member 102 may extend beyond the rear surfaces of the upper and lower portions 104*b* and 104*c* of the vertical member 104 when the horizontal member 102 is attached to the vertical member 104.

In some aspects, the cross 100 may include one or more attachment components (e.g., one or more screws, bolts, magnets, and/or ties) configured to attach the attach block 202 of the horizontal member 102 to the rear vertical panel 310 of the vertical member 104. In some aspects, the one or more attachment components may pass through the rear vertical panel 310 of the vertical member 104, through the front attach block surface 202*a* of the attach block 202, and into the attach block 202. However, one or more attachment components are not required, and, in some alternative aspects, the horizontal member 102 of the cross 100 may be configured to attach to the vertical member 104 without the use of one or more attachment components.

Figure 3C:
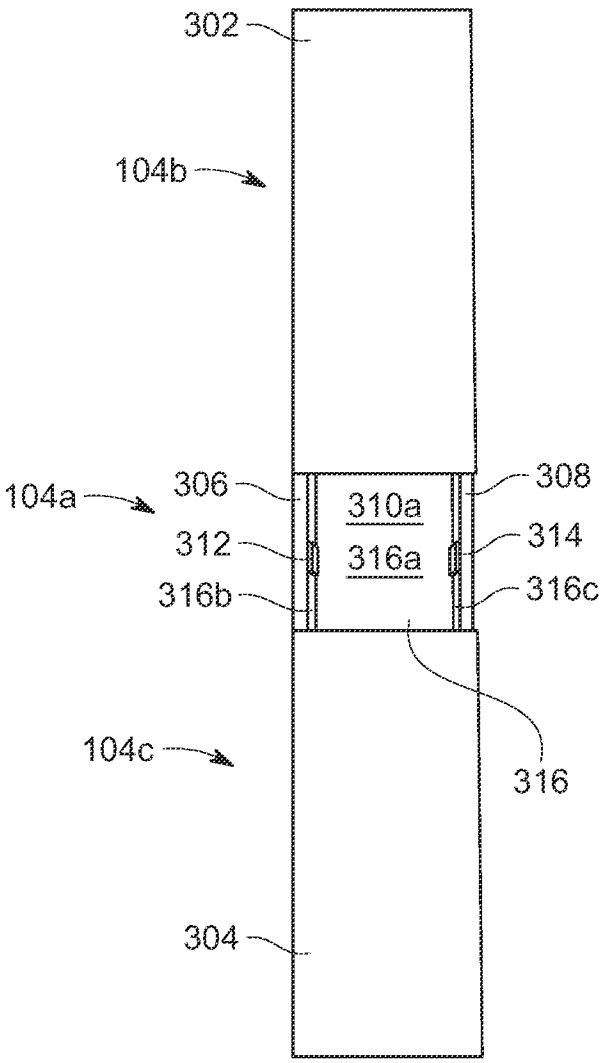
FIG. 3C is a front view of a vertical member of a cross according to some aspects.
Figure 4:
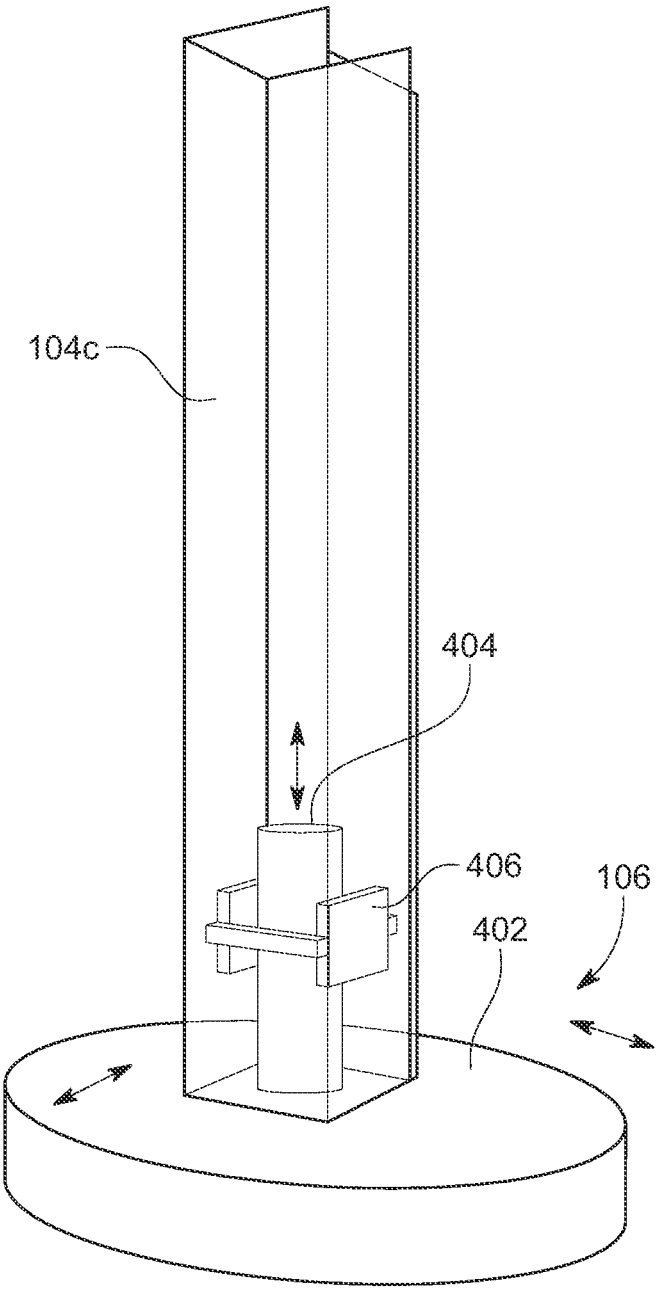
FIG. 4 illustrates a base of a cross according to some aspects.

In some aspects, as shown in FIGS. 2B-2D, 2F, 2G, and 3A-3C, the cross 100 may include a rail system configured to facilitate attachment of the horizontal member 102 to the vertical member 104. In some aspects, as shown in FIGS. 3A-3C, the rail system may include a first rail component 312 on the first cavity side surface 316*b* of the attach block cavity 316 of the vertical member 104 and/or a second rail component 314 on the second cavity side surface 316*c* of the attach block cavity 316 of the vertical member 304. In some aspects, as shown in FIGS. 2B-2D, 2F, and 2G, the rail system may include a third rail component 218 on the first side attach block surface 202*b* of the attach block 202 of the horizontal member 102, and a fourth rail component 220 on the second side attach block surface 202*c* of the attach block 202 of the horizontal member 102. In some aspects, the third rail component 218 on the first side attach block surface 202*b* of the attach block 202 of the horizontal member 102 may configured to interact with (e.g., slide into and/or be supported by) the first rail component 312 during attachment of the horizontal member 102 to the vertical member 104. In some aspects, the fourth rail component 220 on the second side attach block surface 202*c* of the attach block 202 of the horizontal member 102 may be configured to interact with (e.g., slide into and/or be supported by) the second rail component 314 during attachment of the horizontal member 102 to the vertical member 104.

In some aspects, as shown in FIGS. 1A-1E, 4, 6A, and 6B, the base 106 may be configured to attach to the lower portion 104*c* of the vertical member 104 such that, when attached, the base 106 maintains the vertical member 104 in an upright position. In some aspects, the base 106 may be a weighted based. In some aspects, the base 106 may be a deck umbrella type base. In some aspects, as shown in FIGS. 4, 6A, and 6B, the base 106 may include a base platform 402 and a base projection 404. In some aspects, as shown in FIGS. 4, 6A, and 6B, the base projection 404 may be configured to be inserted into the lower portion of the vertical member 104. In some aspects, the vertical member 104 (e.g., the lower portion 104*c* of the vertical member 104) may include an adapter 406. In some aspects, the adapter 406 may be configured to adapt the shape of the hollow lower portion 104*c* of the vertical member 104 to the shape of the base projection 404. In some aspects, the adapter 406 may be a stabilizing interface between the interior hollow lower portion 104*c* of the vertical member 104 and the base projection 404. In some alternative aspects, the base projection 404 may be configured to receive the lower portion 104*c* of the vertical member 104 (e.g., the base 106 may maintain the vertical member 104 in an upright position after the lower portion 104*c* of the vertical member 104 is inserted into the base projection 404).

In some aspects, as shown in FIGS. 5A-5D, at least the lower portion 104*c* of the vertical member 104 may include one or more support platforms 602. In some aspects, each of the one or more support platforms 602 may be secured to the front surface 310*a* of the rear vertical panel 310, the inner side surface of the first side vertical panel 306, and/or the inner side surface of the second side vertical panel 308. In some aspects, each of the one or more support platforms 602 may include an opening through the support platform 602.

Figure 5B:
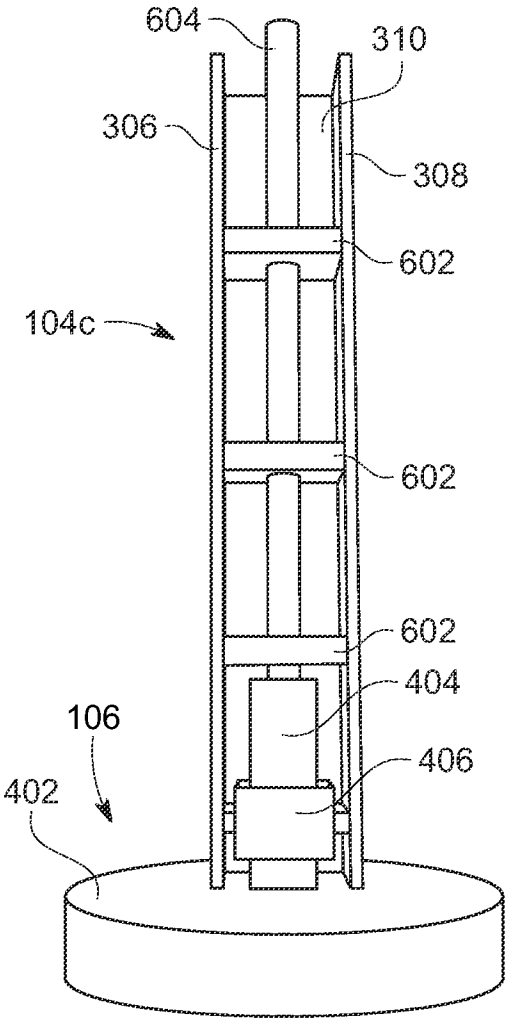
FIGS. 5A-5D illustrate a support system of a cross according to some aspects.
Figure 5A:
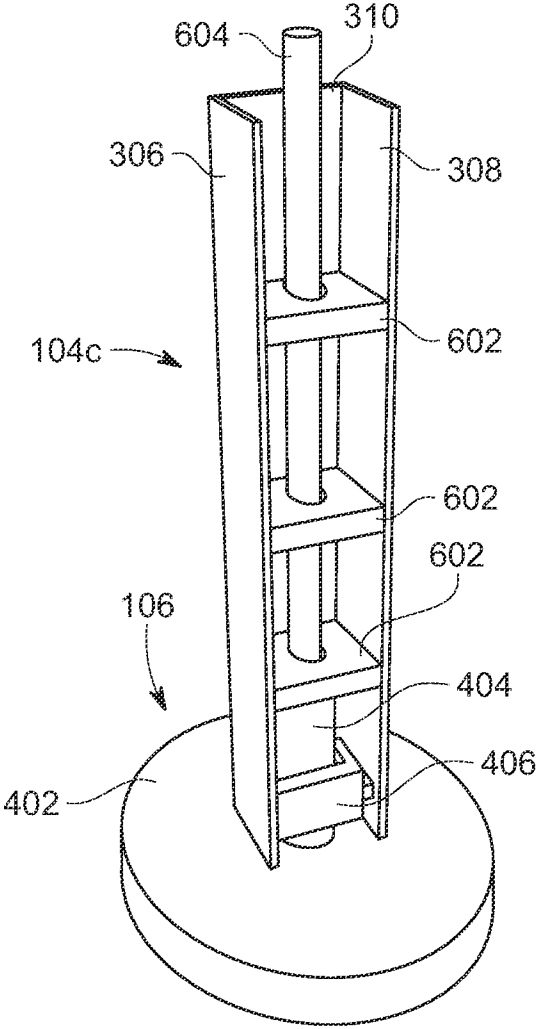

In some aspects, as shown in FIGS. 5A and 5B, the cross 100 may include a support rod 604. In some aspects, the base projection 404 of the base 106 may include an opening configured to receive the support rod 604. In some aspects, as shown in FIGS. 5A and 5B, the support rod 604 may be configured to extend from the base projection 404 and into the lower portion 104*c* of the vertical member 104 when the vertical member 104 is placed on the base 106. In some aspects, as shown in FIGS. 5A and 5B, the support rod 604 may be configured to extend from the base projection 404 and through the opening(s) of the one or more support platforms 602 of the lower portion 104*c* of the vertical member 104 when the vertical member 104 is placed on the base 106. In some aspects, the opening through each of the one or more support platforms 602 may be located at a center of a horizontal cross-section of the support platform 602, which may also be at a center of a horizontal cross-section of the lower portion 104*c* of the vertical member 104. As such, in some aspects, the support rod 604 may run through the center of the lower portion 104*c* of the vertical member 104.

Figure 5D:
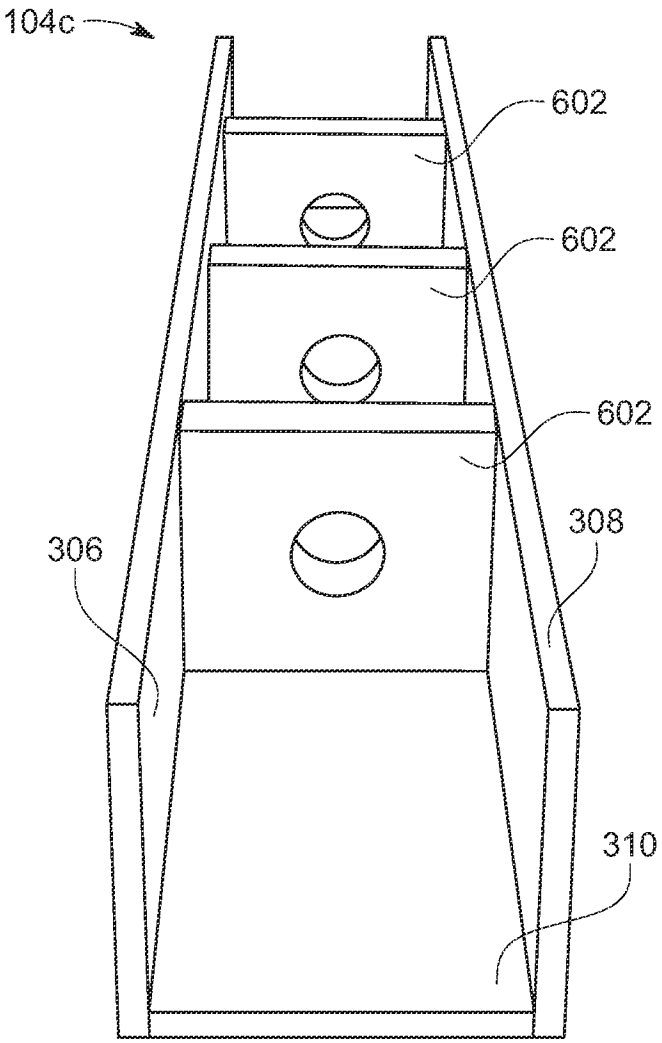
Figure 5C:
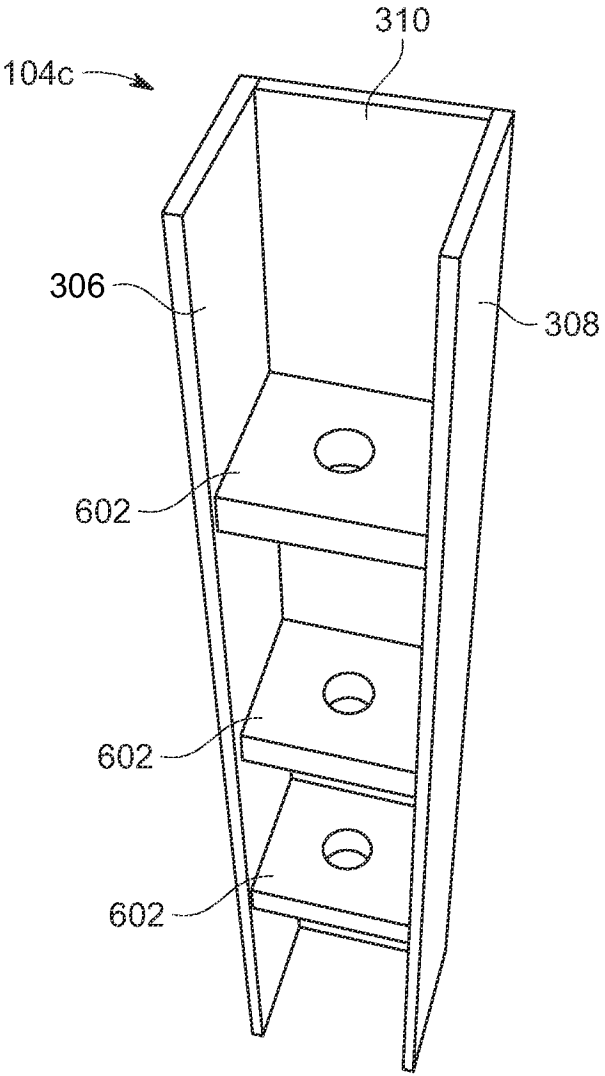

For purposes of illustration, FIGS. 5A-5D show the lower portion 104*c* of the vertical member 104 without the lower front vertical panel 304, and FIGS. 5C and 5D show the lower portion 104*c* of the vertical member 104 without the adapter 406. In FIGS. 5A-5D, only a portion of the lower portion 104*c* of the vertical member 104, and, in some aspects, the support rod 604 may not extend from the lower portion 104*c* of the vertical member 104. That is, in some aspects, the support rod 604, when placed in the opening of the base projection 404 of the base 106, the support rod 604 may not extend through the lower portion 104*c* of the vertical member 104 and into the attach block cavity 316. To the contrary, in some aspects, when placed in the opening of the base projection 404 of the base 106, the support rod 604 may extend from the base projection 404 and into the lower portion 104*c* of the vertical member 104 (and through the openings of the one or more support platforms 602) and stop before reaching the attach block cavity 316.

In some aspects, the base projection 404, the adaptor 406, the one or more support platforms 602, and/or the support rod 604 (e.g., as shown in FIGS. 5A-5D) may form a support system of the cross 100. In some aspects, the support system may provide improved structural solidification and/or rigidity. In some aspects, the support system (e.g., including the support rod 604 passing through the opening(s) of the one or more support platforms 602 may allow the base 102 to be structurally integrated with the structure of the cross 100. In some aspects, the support system may additionally or alternatively contribute additional weight close to the base 106, which may contribute to preventing toppling of the cross 100.

In some aspects, as shown in FIGS. 5A and 5B, the support rod 604 may be a cylinder. However, this is not required, and, in some alternative aspects, the support rod 604 may be a different shape (e.g., a rectangular prism). In some aspects, the opening(s) through the one or more support platforms may have a shape that corresponds to the shape of the support rod 604. For example, in some aspects in which the support rod 604 is a cylinder, as shown in FIGS. and 5D, the opening(s) through the one or more support platforms 602 may have a circular cross-section.

In some aspects, one or more of the horizontal and vertical members 102 and 104 may comprise wood. In some aspects, one or more of the attach block 202, front horizontal panel 204, first side top panel 206, first side rear panel 208, first side bottom panel 210, second side top panel 212, second side rear panel 214, and second side bottom panel 216, and end caps 110 of the horizontal member may comprise wood. In some aspects, one or more of the upper front vertical panel 302, lower front vertical panel 304, first side vertical panel 306, second side vertical panel 308, rear vertical panel 310, and top end cap 108 of the vertical member 104 may comprise wood. In some aspects, the horizontal member 102 and/or the vertical member 104 (e.g., one or more components of the horizontal member 102 and/or the vertical member 104) may include one or more materials (e.g., plastic and/or metal) in addition to or instead of wood.

In some aspects, the horizontal member 102 may be capable of being easily attached to the vertical member 104. In some aspects, the horizontal member 102 may be configured to attach to the vertical member with minimal or no use of tools. In some aspects (e.g., in some aspects in which the horizontal member 102 and/or the vertical member 104 have a hollow cross-section), the cross 100 may have a relatively low weight, which may minimize weight of the cross 100 and/or the potential for the cross 100 to topple. In some aspects, the connection structure of the cross 100 (e.g., including the attach block 202 and the attach block cavity 316) may enable the horizontal member 102 to attach to the vertical member 104 without the connection structure being visible (e.g., at least not visible from the front, the left side, and/or right side). In some aspects, the cross 100 may be configured for repeated assembly and disassembly (e.g., by one or two persons). In some aspects, the cross 100 may be suitable for seasonal and/or decorative usage.

A process may include a first step of attaching the lower portion 104*c* of the vertical member 104 to the base 106 such that the base 106 maintains the vertical member 104 in an upright position. In some aspects, the process may include a second step of attaching the horizontal member 102 to the vertical member 104. In some aspects, the process may include a third step of detaching the horizontal member 102 from the vertical member 104. In some aspects, the process may include a fourth step of detaching the vertical member 104 from the base 106.

Another process may include a first step of inserting a support rod 604 into an opening of a base projection 404 of a base 106 such that the support rod 604 extends from the base projection 404 of the base 106. In some aspects, the process may include a second step of attaching a lower portion 104*c* of a vertical member 104 to the base 106 such that the base 106 maintains the vertical member 104 in an upright position. In some aspects, attaching the lower portion 104*c* of the vertical member 104 to the base 106 may include passing the support rod 604 through an opening in each of one or more support platforms 602 of the lower portion 104*c* of the vertical member 104. In some aspects, attaching the lower portion 104*c* of the vertical member 104 to the base 106 may include inserting the base projection 404 of the base 106 into an adapter 406 of the lower portion 104*c* of the vertical member 104. In some aspects, the process may include a third step of attaching the horizontal member 102 to the vertical member 104. In some aspects, the process may include a fourth step of detaching the horizontal member 102 from the vertical member 104. In some aspects, the process may include a fifth step of detaching the vertical member 104 from the base 106. In some aspects, the process may include a sixth step of removing the support rod 604 from the opening of the base projection 404 of the base 106.

In some aspects, the cross 100 may be part of a crucifix. In some aspects, the crucifix may include the cross 100 and a depiction of the body of Jesus. In some aspects, the depiction of the body of Jesus may be configured to be attached to the cross 100.

While various embodiments are described herein, it should be understood that they have been presented by way of example only, and not limitation. Thus, the breadth and scope of this disclosure should not be limited by any of the above-described exemplary embodiments. For example, in some alternative aspects, the vertical member 104 may include the attach block, and the horizontal member 102 may include the attach block cavity. Moreover, any combination of the above-described elements in all possible variations thereof is encompassed by the disclosure unless otherwise indicated herein or otherwise clearly contradicted by context.

Additionally, while the processes described above as a sequence of steps, this was done solely for the sake of description. Accordingly, it is contemplated that some steps may be added, some steps may be omitted, the order of the steps may be re-arranged, and some steps may be performed in parallel.

What is claimed is:

1. A cross comprising:

(1) a horizontal member including:

(1A) a central portion comprising an attach shape, wherein the attach shape includes first and second side attach shape surfaces and a front attach shape surface extending between the first and second side attach shape surfaces;

(1B) a first side portion extending from the central portion in a first horizontal direction, wherein the first side portion comprises front, rear, top, and bottom surfaces; and (1C) a second side portion extending from the central portion in a second horizontal direction opposite to the first horizontal direction, wherein the second side portion comprises front, rear, top, and bottom surfaces;

(2) a vertical member including:

(2A) a support portion comprising a cavity, wherein the cavity comprises first and second cavity side surfaces and a cavity rear surface;

(2B) an upper portion extending from the support portion in an upward direction, wherein the upper portion comprises a front surface, a rear surface, a first side surface, and a second side surface; and (2C) a lower portion extending from the support portion in a downward direction, wherein the lower portion comprises a front surface, a rear surface, a first side surface, and a second side surface; and (3) a rail system configured to facilitate attachment of the horizontal member to the vertical member, wherein the rail system comprises:

(3A) a first rail component on the first cavity side surface of the cavity of the vertical member;

(3B) a second rail component on the second cavity side surface of the cavity of the vertical member;

(3C) a third rail component on the first side attach shape surface of the attach shape of the horizontal member and configured to interact with the first rail component during attachment of the horizontal member to the vertical member; and (3D) a fourth rail component on the second side attach shape surface of the attach shape of the horizontal member and configured to interact with the second rail component during attachment of the horizontal member to the vertical member;

wherein the horizontal member is configured to attach to the vertical member such that, when attached:

the cavity rear surface of the cavity of the vertical member faces the front attach shape surface of the attach shape of the horizontal member;

the first cavity side surface of the cavity of the vertical member faces the first side attach shape surface of the attach shape of the horizontal member;

the second cavity side surface of the cavity of the vertical member faces the second side attach shape surface of the attach shape of the horizontal member; and the vertical member supports the attach shape of the horizontal member.

2. The cross of claim 1, wherein the support portion of the vertical member supports the attach shape of the horizontal member.

3. The cross of claim 1, wherein the upper and lower portions of the vertical member are hollow, and/or the first and second side portions of the horizontal member are hollow.

4. The cross of claim 1, wherein the vertical member comprises a rear vertical panel including front and rear surfaces, the cavity rear surface of the support portion of the vertical member comprises a portion of the front surface of the rear vertical panel, the rear surface of the upper portion of the vertical member comprises an upper portion of the rear surface of the rear vertical panel of the vertical member, and the rear surface of the lower portion of the vertical member comprises a lower portion of the rear surface of the rear vertical panel of the vertical member.

5. The cross of claim 4, further comprising one or more attachment components configured to attach the attach shape of the horizontal member to the rear vertical panel of the vertical member.

6. The cross of claim 1, wherein the vertical member comprises a first side vertical panel including inner and outer side surfaces, the first cavity side surface of the cavity of the vertical member comprises a portion of the inner side surface of the first side vertical panel, the first side surface of the upper portion of the vertical member comprises an upper portion of the outer side surface of the first side vertical panel, and the first side surface of the lower portion of the vertical member comprises a lower portion of the outer side surface of the first side vertical panel.

7. The cross of claim 1, wherein the vertical member comprises a second side vertical panel including inner and outer side surfaces, the second cavity side surface of the cavity of the vertical member comprises a portion of the inner side surface of the second side vertical panel, the second side surface of the upper portion of the vertical member comprises an upper portion of the outer side surface of the second side vertical panel, and the second side surface of the lower portion of the vertical member comprises a lower portion of the outer side surface of the second side vertical panel.

8. The cross of claim 1, wherein the upper portion of the vertical member comprises an upper front vertical panel, the front surface of the upper portion of the vertical member comprises a front portion of the upper front vertical panel, the lower portion of the vertical member comprises a lower front vertical panel, and the front surface of the lower portion of the vertical member comprises a front portion of the lower front vertical panel.

9. The cross of claim 1, wherein the horizontal member comprises a front horizontal panel including front and rear surfaces, the attach shape of the central portion of the horizontal member extends from the rear surface of the front horizontal panel, the front surface of the first side portion of the horizontal member comprises a portion of the front surface of the front horizontal panel, and the front surface of the second side portion of the horizontal member comprises a different portion of the front surface of the front horizontal panel.

10. The cross of claim 9, wherein the rear surface of the front horizontal panel of the horizontal member is configured to abut first and second side vertical panels of the vertical member when the horizontal member is attached to the vertical member.

11. The cross of claim 1, wherein:

the first side portion of the horizontal member comprises a first side top panel, a first side rear panel, and a first side bottom panel;

the top surface of the first side portion of the horizontal member comprises a top surface of the first side top panel;

the rear surface of the first side portion of the horizontal member comprises a rear surface of the first side rear panel; and the bottom surface of the first side portion of the horizontal member comprises a bottom surface of the first side bottom panel.

12. The cross of claim 1, wherein:

the second side portion of the horizontal member comprises a second side top panel, a second side rear panel, and a second side bottom panel;

the top surface of the second side portion of the horizontal member comprises a top surface of the second side top panel;

the rear surface of the second side portion of the horizontal member comprises a rear surface of the second side rear panel; and the bottom surface of the second side portion of the horizontal member comprises a bottom surface of the second side bottom panel.

13. The cross of claim 1, wherein the front attach shape surface of the attach shape of the horizontal member is configured to abut the cavity rear surface of the cavity of the vertical member when the horizontal member is attached to the vertical member.

14. The cross of claim 1, further comprising a base configured to attach to the lower portion of the vertical member such that, when attached, the base maintains the vertical member in an upright position.

15. The cross of claim 14, wherein the base comprises a base projection configured to be inserted into the lower portion of the vertical member.

16. The cross of claim 15, wherein the lower portion of the vertical member comprises one or more support platforms, each of the one or more support platforms comprises an opening through the support platform, and the cross further comprises a support rod configured to extend from the base projection and through the opening(s) of the one or more support platforms.

17. A cross comprising:

(1) a horizontal member;

(2) a vertical member including:

(2A) a support portion;

(2B) an upper portion extending from the support portion in an upward direction, wherein the upper portion comprises a front surface, a rear surface, a first side surface, and a second side surface;

(2C) a lower portion extending from the support portion in a downward direction, wherein the lower portion of the vertical member comprises a front surface, a rear surface, a first side surface, a second side surface, and one or more support platforms, and each of the one or more support platforms comprises an opening through the support platform;

(2D) a rear vertical panel including front and rear surfaces, wherein the rear surface of the upper portion of the vertical member comprises an upper portion of the rear surface of the rear vertical panel of the vertical member, and the rear surface of the lower portion of the vertical member comprises a lower portion of the rear surface of the rear vertical panel of the vertical member;

(2E) a first side vertical panel including inner and outer side surfaces, the first side surface of the upper portion of the vertical member comprises an upper portion of the outer side surface of the first side vertical panel, and the first side surface of the lower portion of the vertical member comprises a lower portion of the outer side surface of the first side vertical panel; and (2F) a second side vertical panel including inner and outer side surfaces, the second side surface of the upper portion of the vertical member comprises an upper portion of the outer side surface of the second side vertical panel, and the second side surface of the lower portion of the vertical member comprises a lower portion of the outer side surface of the second side vertical panel;

(3) a base configured to attach to the lower portion of the vertical member such that, when attached, the base maintains the vertical member in an upright position, wherein the base comprises a base projection configured to be inserted into the lower portion of the vertical member; and (4) a support rod configured to extend from the base projection and through the opening(s) of the one or more support platforms;

wherein the horizontal member is configured to attach to the vertical member such that, when attached, the vertical member supports the horizontal member;

wherein each of the one or more support platforms is secured to the front surface of the rear vertical panel, the inner side surface of the first side vertical panel, and the inner side surface of the second side vertical panel.

18. A method comprising:

inserting a support rod into an opening of a base projection of a base such that the support rod extends from the base projection of the base;

attaching a lower portion of a vertical member to the base such that the base maintains the vertical member in an upright position, wherein attaching the lower portion of the vertical member to the base includes passing the support rod through an opening in each of one or more support platforms of the lower portion of the vertical member, and the vertical member includes:

(2A) a support portion;

(2B) an upper portion extending from the support portion in an upward direction, wherein the upper portion comprises a front surface, a rear surface, a first side surface, and a second side surface;

(2C) the lower portion extending from the support portion in a downward direction, wherein the lower portion of the vertical member comprises a front surface, a rear surface, a first side surface, a second side surface, and the one or more support platforms;

(2D) a rear vertical panel including front and rear surfaces, wherein the rear surface of the upper portion of the vertical member comprises an upper portion of the rear surface of the rear vertical panel of the vertical member, and the rear surface of the lower portion of the vertical member comprises a lower portion of the rear surface of the rear vertical panel of the vertical member;

(2E) a first side vertical panel including inner and outer side surfaces, the first side surface of the upper portion of the vertical member comprises an upper portion of the outer side surface of the first side vertical panel, and the first side surface of the lower portion of the vertical member comprises a lower portion of the outer side surface of the first side vertical panel; and (2F) a second side vertical panel including inner and outer side surfaces, the second side surface of the upper portion of the vertical member comprises an upper portion of the outer side surface of the second side vertical panel, and the second side surface of the lower portion of the vertical member comprises a lower portion of the outer side surface of the second side vertical panel; and attaching a horizontal member to the vertical member such that, when attached, the vertical member supports the horizontal member;

wherein each of the one or more support platforms is secured to the front surface of the rear vertical panel, the inner side surface of the first side vertical panel, and the inner side surface of the second side vertical panel.

* * * * *